US005306869A

United States Patent [19]

Springer et al.

[11] Patent Number: 5,306,869

[45] Date of Patent: * Apr. 26, 1994

[54] RIBBON CABLE CONSTRUCTION

[75] Inventors: Denis D. Springer, Austin, Tex.; Harry A. Loder, Paradise, Calif.

[73] Assignee: Minnesota Mining and Manufacturing Company, St. Paul, Minn.

[ * ] Notice: The portion of the term of this patent subsequent to Feb. 15, 2011 has been disclaimed.

[21] Appl. No.: 949,778

[22] Filed: Sep. 22, 1992

Related U.S. Application Data

[63] Continuation-in-part of Ser. No. 766,578, Sep. 27, 1991.

[51] Int. Cl.[5] ..... H01B 7/08; H01B 7/34

[52] U.S. Cl. ..... 174/36; 156/53; 156/55; 174/102 R; 174/102 D; 174/110 FC; 174/110 F; 174/117 F

[58] Field of Search ..... 174/102 R, 102 D, 117 F, 174/117 FF, 110 PM, 110 FC, 110 F, 36; 156/52, 53, 55

[56] References Cited

U.S. PATENT DOCUMENTS

| | | | |
|---|---|---|---|
| 2,952,728 | 9/1960 | Yokose . | |
| 3,523,844 | 5/1964 | Crimmins et al. | 156/52 |
| 3,529,340 | 9/1970 | Polizzano et al. | 29/202.5 |
| 3,802,974 | 4/1974 | Emmel | 156/55 |
| 3,953,566 | 4/1976 | Gore | 264/288 |
| 4,187,390 | 2/1980 | Gore | 174/102 R |
| 4,218,581 | 8/1980 | Suzuki | 174/117 F |
| 4,375,379 | 3/1983 | Luetzow | 156/52 |
| 4,443,657 | 4/1984 | Hill et al. | 174/110 |
| 4,475,006 | 10/1984 | Olyphant, Jr. | 174/36 |
| 4,533,784 | 8/1985 | Olyphant, Jr. | 174/36 |
| 4,539,256 | 9/1985 | Shipman | 428/315.5 |
| 4,596,897 | 6/1986 | Gruhn | 174/36 |
| 4,640,569 | 2/1987 | Dola et al. | 339/143 |
| 4,642,480 | 2/1987 | Hughes et al. | 307/147 |
| 4,645,868 | 2/1987 | Suzuki | 174/117 F |
| 4,663,098 | 5/1987 | Gilliam et al. | 264/104 |
| 4,673,904 | 6/1987 | Landis | 333/238 |
| 4,680,423 | 7/1987 | Bennett et al. | 174/36 |
| 4,711,811 | 12/1987 | Randa | 428/383 |
| 4,716,073 | 12/1987 | Randa | 428/215 |
| 4,726,989 | 2/1988 | Mrozinski | 428/315.5 |
| 4,730,088 | 3/1988 | Suzuki | 174/102 R |
| 4,866,212 | 9/1989 | Ingram | 174/28 |
| 4,988,835 | 1/1991 | Shah | 174/117 F |
| 5,030,794 | 7/1991 | Schell et al. | 174/36 |
| 5,110,998 | 5/1992 | Muschiatti | 174/24 |

FOREIGN PATENT DOCUMENTS

| | | | |
|---|---|---|---|
| 1256173 | 1/1986 | Canada | 337/66 |
| 3527846A1 | 2/1987 | Fed. Rep. of Germany . | |
| 9201301 | 1/1992 | PCT Int'l Appl. | 174/117 F |
| 9204719 | 3/1992 | PCT Int'l Appl. | 174/117 F |
| WO92/01301 | 1/1992 | World Int. Prop. O. | H01B 7/08 |

OTHER PUBLICATIONS

Electronic Design, Sep. 28, 1989.
Connection Technology, pp. 27–29, Jun. 1991.
Item 1991, pp. 180–187.
Electronic Products, Oct. 1989.
Unlimited Design Possibilities, Feb. 1990.

*Primary Examiner*—Morris H. Nimmo
*Attorney, Agent, or Firm*—Gary L. Griswold; Walter N. Kirn; John C. Barnes

[57] ABSTRACT

Ribbon cables have lower capacitance, higher impedance, and faster propagation velocities with microporous fibril thermoplastic dielectric insulation, because they have great amounts of air adjacent to the conductors and the improved electrical performance is due in part to the improved crush resistance. Crystallizable thermoplastic polymers having good fibril structure and crush resistance include polyolefins such as polypropylene and polymethylpentene. A layer of metal adhered to the dielectric insulation provides improved transmission line properties.

23 Claims, 7 Drawing Sheets

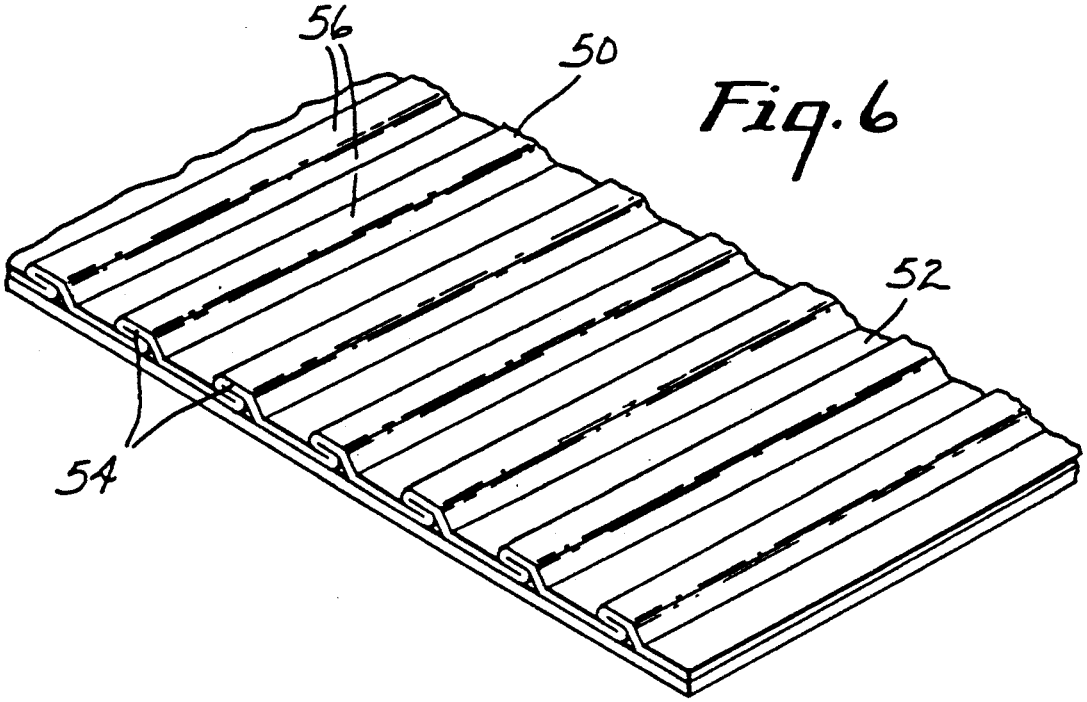
Fig. 6
Fig. 7
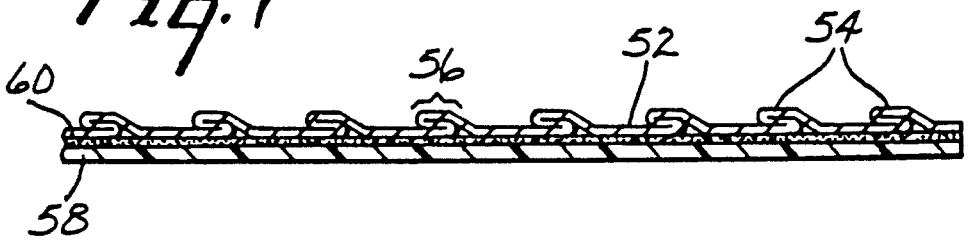
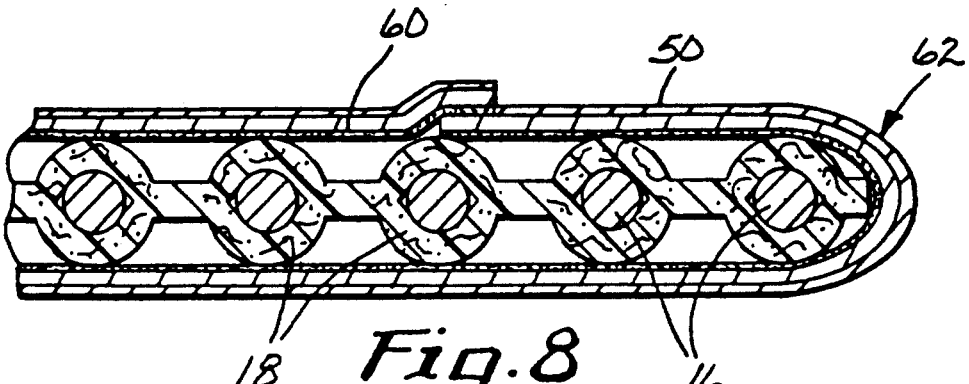
Fig. 8

RIBBON CABLE CONSTRUCTION

RELATED CASE

This application is a continuation-in-part of application Ser. No. 07/766,578, filed Sep. 27, 1991.

BACKGROUND OF THE INVENTION

1. Field of the Invention

This invention relates to an improved electrical cable and process for making the subject cable having a low dielectric constant, and in particular, a flexible shielded ribbon cable having multiple conductors with improved transmission line characteristics, improved crush resistance and good mechanical characteristics for mass termination.

2. Description of Prior Art

There already exist in the marketplace multiconductor flexible, mass terminable cables having transmission line characteristics such as controlled impedance, crosstalk, propagation delay, etc. It is well known that by lowering the effective dielectric constant of the cable by including air in the dielectric, the signal speed can be increased.

Providing porosity in a dielectric suitable for cables is known. Foam type insulations are known from U.S. Pat. No. 3,529,340, where the foam coated conductors were placed in a sheath which is shrunk onto the foam covered conductors. Another patent is U.S. Pat. No. 4,680,423, disclosing a foam insulation said to contain a large percentage of air trapped within the material. In this patent, foam covered conductors are embedded within an insulating material which completely surrounds the foam insulation. The insulating material is used to hold the conductors in a parallel configuration and provides strength to the cable when subjected to compression.

Another patent describing a foamed insulative material for conductors includes U.S. Pat. No. 5,110,998, issued May 5, 1992 describing an ultramicrocellular foamed polymer structure formed from suitable polymers including the class of synthetic, crystalline and crystallizable, organic polymers, e.g. polyhydrocarbons such as linear polyethylene, polypropylene, stereoregular polypropylenes or polystyrene, polyethers such as polyvinylidene fluoride, polyamides both aliphatic and aromatic, and the list goes on, but concludes the polymers should have a softening point of at least about 40° C. The high degree of orientation of the closed polyhedral cells, of this foamed material, contributes to the strength of the structures. The foamed structure is described for use as an insulative material for individual conductors smaller than 1.27 mm and annular insulation thickness less than 0.51 mm. The insulative material is flash spun over a moving wire in air at ambient temperature and pressure or by an extrusion spinning method. The crush resistance of the material is described in column 3 lines 64 to column 4 line 9. The recovery rate is not considered sufficient to provide good electrical properties to signal wire and the material is not suitable for making ribbon cable.

Further, W. L. Gore & Associates, Inc. sells cable made with "Gortex" TM" dielectric films, a porous polytetrafluoroethylene (PTFE). Polytetrafluoroethylene is not a conventional thermoplastic and is not easily processed and is costly. Various patents have been assigned to W. L. Gore & Associates, Inc. of Newark, Del. including U.S. Pat. Nos. 3,953,566 and 4,187,390 relating to the process for making a porous polytetrafluoroethylene polymer; 4,443,657 which relates to the manufacture of a ribbon cable using two layers of polytetrafluoroethylene (PTFE) as insulation, and 4,866,212 relating a coaxial electric cable formed of an expanded polytetrafluoroethylene.

U.S. Pat. No. 4,475,006 describes a shielded ribbon cable comprising a plurality of conductors encased in a low-loss plastic or elastomer insulation such as polyethylene, polypropylene, polyurethane, tetrafluoroethylene polymer, fluorinated ethylene propylene and EPDM rubber, and a shield wrapped around the cable and adhered to the insulation. The shield material preferably had a maximum resistivity (minimum conductivity) of 3.5 milliohms per square and examples of the shielding material included a copper foil, an aluminum foil/polyester laminate or an expanded copper foil mesh. The shield was cigarette wrapped about the insulation with the shield bonded to the insulation to provide an effective uniform transverse and longitudinal dielectric constant.

Another patent which teaches the construction of a shielded ribbon cable is U.S. Pat. No. 4,533,784 which describes an electrical shield having a continuous metallic foil having a plurality of transverse folds to provide a shielded cable with greater flexibility and less subject to cracking. This patent discloses one type of shielding material usable for the cable of the present invention.

High speed cables of the prior art generally utilize expanded PTFE dielectrics such as those sold by W. L. Gore & Associates, Inc. or foamed perfluoro polymers. Such cable structures have reduced crush resistance as compared to solid dielectrics. This reduced crush resistance results in reduced transmission line characteristics as a result of damage caused by normal routing or handling of cables made from these conventional dielectrics.

Because of the very high processing temperatures, cables made in ribbon format with polytetrafluoroethylene generally have silver plated or nickel plated conductors to avoid the oxidation of the conductors during processing. Use of either causes significant cost increase. In addition, if nickel is used, difficulty in soldering to the conductors is encountered.

It should be noted that lamination and fusion of thermoplastic insulations to make ribbon cables has been taught in the prior art such as U.S. Pat. No. 3,523,844 assigned to David J. Crimmins, et. al. and U.S. Pat. No. 2,952,728 assigned to Kyohei Yokose, et. al. The Crimmins patent teaches lamination of solid dielectrics around variably spaced wires. This method will not work with air filled dielectrics without collapsing the air filled structure. Similarly, The Yokose patent teaches lamination of solid dielectrics around conductors. However, the tool or roller design employed will cause excessive melting and destruction of the fibril structure of the material in the present invention. Both of the methods employed in the prior art would not work with the materials presented herein. The process and materials of the present invention teach lamination without significant destruction or collapse of the air filled structure adjacent the conductors.

U.S. Pat. No. 4,443,657, assigned to W. L. Gore & Associates, Inc., demonstrates a means of bonding sheets of PTFE using a sintering process. The softness of the unsintered core dielectric forces the inventor to place a solid layer of insulation over the top of the unsintered core resulting in significant reductions in electrical performance of the finished cable due to the solid dielectric.

The crush resistance of dielectrics which contain large percentages of air voids has long been a problem in the use of high speed dielectrics. In U.S. Pat. No. 4,730,088 assigned to Junkosha Co., LTD., Japan, expanded polytetrafluoroethylene (PTFE) was reinforced by use of a laser beam or a hot metal rod. The piercing of the soft insulation by the beam or rod caused a unique phenonema to occur to the porous PTFE called sintering. In this case, the sintering causes the soft dielectric to form a solid skin of PTFE on the inside wall of the created hole. Since sintered PTFE has many times the structural strength of the unsintered porous dielectric, the cylinders so created act like beams to resist crushing forces. An alternate method disclosed, used heated rolls to put grooves in the surface of the insulation. Both methods sole purpose is to increase the crush resistance of the insulation. Both disclosed solutions suffer from the creation of discontinuities in the dielectric which add to signal speed variation as the electrical fields encounter these discontinuities.

The product disclosed in the present application also has improved crush resistance over unsintered expanded polytetrafluoroethylene without the time consuming and expensive process of forming sintered cylinders or grooves in the dielectric. This product, in addition to having the improved electrical properties at substantially reduced cost and with improved crush resistance, does not have the dielectric discontinuities associated with the formation of sintered shapes as with prior art. The process used to form this product also can be accomplished at substantially reduced temperatures permitting conductors to be used with or without plating which provides additional cost reduction. The unique crush resistant properties of the subject product result since the polymers employed to make the insulation do not have the uncharacteristic changes called sintering but rather have the improved properties immediately upon cooling thus eliminating costly and time consuming sintering processes.

The prior art demonstrates that many attempts have been made to provide electrical cables with lower dielectric constant and/or fixed shield-wire spacing to improve electrical characteristics. The prior art cables sacrifice durability and crush resistance to achieve lower dielectric constant and faster propagation velocities. This is in part due to the necessity to employ polymer structures which are inherently soft or weak in their structural integrity. Examples being the foamed materials and porous polytetrafluoroethylene polymer.

The present invention provides an improved cable construction which can have lower dielectric constants and higher propagation velocities and maintain the same uniformity along the cable, even though it is flexed since the dielectric is more crush resistant and the shield is maintained in spaced position at the areas where the cable is flexed. In addition the processing of the product is done at lower temperature permitting the use of conductors with or without plating.

SUMMARY OF THE INVENTION

The present invention relates to a cable for transmitting electromagnetic signals which cable comprises conductors and a layer of thermally stable, crush resistant, fibril microporous heat sealable thermoplastic crystallizable polymer dielectric surrounding the conductor, said dielectric having a void volume in excess of 70%, a propagation velocity of the insulated conductor greater than 75% the propagation velocity in air and the recovery rate after being under a 500 gram weight for 10 minutes greater than 92% of the initial thickness. It is desirable to have the material have a density less than 0.3 gm/cc. The microporous thermoplastic material is surrounded by a thin layer of conductive metal placed to surround the microporous thermoplastic material and conductors. A cable as described has the metal layer adhered to the microporous thermoplastic material which is a crystallizable polymer, such as a polyolefin.

A ribbon cable having a plurality of conductors can be prepared by the lamination of two or more sheets of a microporous thermoplastic material prepared as described in U.S. Pat. Nos. 4,539,256 and 4,726,989. The sheet is a thermoplastic polymer, for example a polyolefin such as polypropylene or polyethylene. The laminating process embeds spaced wires within two layers of the thermoplastic sheet, yet does not collapse the interstices or spaces formed in the sheets, except in the bonding area.

The dielectric having been biaxially expanded contains nodes or nodules with fine diameter fibrils connecting the nodules in three dimensions. Since on a microscopic basis, the insulation is non uniform in density, the rate of heat transfer through the polymer is controlled by the cross sectional area of the fibrils. The application of heat and pressure at the bond zones between the wires has virtually no impact on the dielectric around the conductor as the fibrils are small enough to significantly reduce the rate of heat transfer between the nodules and therefore through the entire dielectric structure. This is an important characteristic since this phenomena prevents the bonding between conductors from causing collapse of the cell structure around the conductors.

The improved and unexpected electrical properties of the ribbon cable according to the present invention are obtained by shielding the fibril insulative conductors with an adhesively bonded metal foil as described in the above referenced patents on shielding.

DESCRIPTION OF THE DRAWING

The present invention will be further described with reference to the accompanying drawing wherein:

FIG. 6 is a perspective view of a section of sheet material for covering a ribbon cable;

FIG. 7 is a side view of the sheet material of FIG. 6;

FIG. 8 is a cross-sectional view of a cable constructed according to FIGS. 1–4, which has been covered by the sheet material of FIG. 6;

DETAILED DESCRIPTION OF SEVERAL PRESENTLY PREFERRED EMBODIMENTS

The present invention provides a novel cable structure having a low dielectric constant, i.e., below the dielectric constant of solid polytetrafluoroethylene and utilizing a thermoplastic material having improved characteristics and economics of processing. The product so disclosed also has improved crush resistance. The product of the present invention in addition to having the improved electrical properties at substantially reduced cost and with improved crush resistance, does not have the dielectric discontinuities associated with the formation of sintered shapes as with the prior art. The process used to form this product also can be accomplished at substantially reduced temperatures permitting conductors to be used with or without plating which provides additional cost reduction. The unique crush resistant properties of the subject product result since the polymers employed to make the insulation do not have the uncharacteristic changes called sintering as with PTFE but rather have the improved properties immediately upon cooling thus eliminating the costly and time consuming sintering processes.

Figure 1:
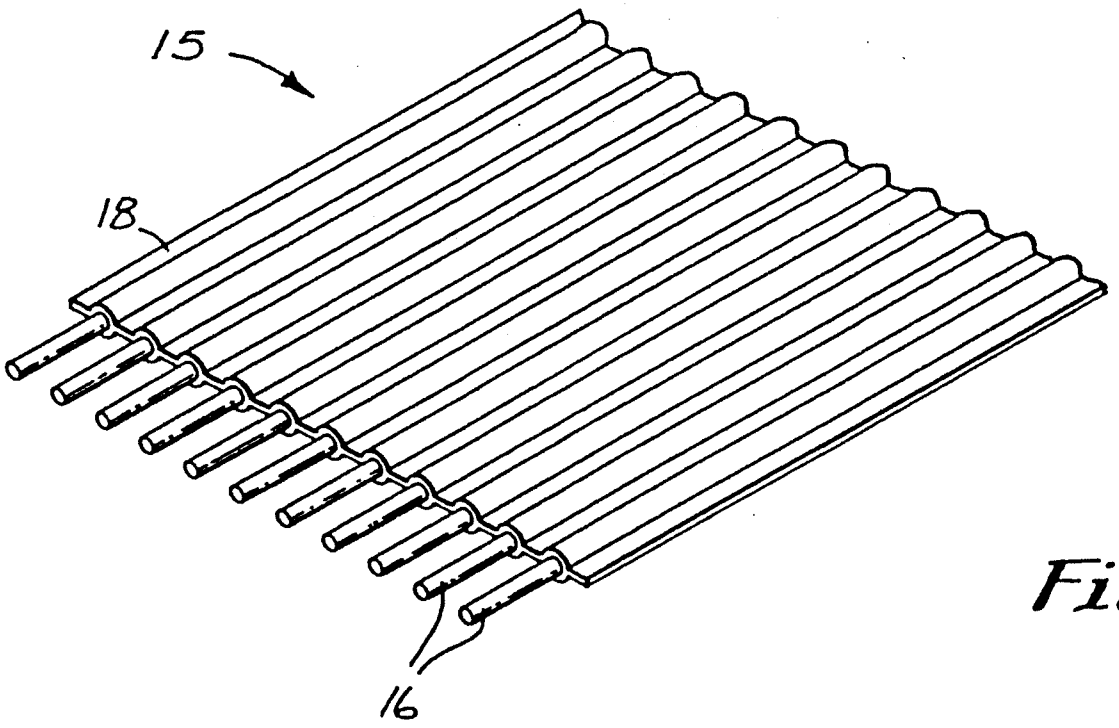
FIG. 1 is a perspective view of a section of cable constructed according to the present invention.

The following detailed description refers to the drawing. Referring now to FIG. 1 there is illustrated a cable 15 comprising a plurality of evenly spaced flexible conductors 16 constructed of any electrically conductive material commonly used in the electronic industry. The cable 15 further comprises an insulator 18 disposed about the conductors 16 to maintain the same in spaced relationship and surrounding the conductors 16. The insulator is preferably a microporous dielectric thermoplastic polymer, e.g. polypropylene formed in continuous sheets or mats and placed on the conductors and bonded together to seal the conductors in spaced relationship. A preferred microporous dielectric is a fibril microporous material made as described in U.S. Pat. Nos. 4,539,256 and 4,726,989, and assigned to Minnesota Mining and Manufacturing Company, of St. Paul, Minn. The disclosures of U.S. Pat. Nos. 4,539,256 and 4,726,989 are incorporated herein by reference.

The U.S. Pat. No. 4,539,256 patent describes a method of making a microporous fibril sheet material comprising the steps of melt blending crystallizable thermoplastic polymer with a compound which is miscible with the thermoplastic polymer at the melting temperature of the polymer but phase separates on cooling at or below the crystallization temperature of the polymer, forming a shaped article of the melt blend. To this blend is also added an anti-oxidant which gives the resulting article high temperature oxidation resistance. The cooling of the shaped article to a temperature at which the polymer crystallizes will cause phase separation to occur between the thermoplastic polymer and the compound to provide an article comprising a first phase comprising particles of crystallized thermoplastic polymer in a second phase of the compound. Orienting the article in at least one direction will provide a network of interconnected micropores throughout. The microporous article comprises about 30 to 80 parts by weight crystallizable thermoplastic polymer and about 70 to 20 parts by weight of compound. The oriented article has a microporous structure characterized by a multiplicity of spaced randomly dispersed, equiaxed, non-uniform shaped particles of the thermoplastic polymer which are coated with the compound. Adjacent thermoplastic particles within the article are connected to each other by a plurality of fibrils consisting of the thermoplastic polymer which are coated with the compound. The fibrils radiate in three dimensions from each particle. The amount of compound may be reduced by removal of the desired quantity from the sheet article, e.g., by solvent extraction. U.S. Pat. No. 4,726,989 relates to a microporous material as described in U.S. Pat. No. 4,539,256, but incorporating a nucleating agent to permit greater quantities of additive compound to be used and providing a higher degree of porosity in the material.

A specific example of forming the thermoplastic material is the following.

Polypropylene (Profax TM 6723, available from Himont Incorporated), 0.25 weight percent (based on the polymer) dibenzylidene sorbitol nucleating agent (Millad TM 3905, available from Milliken Chemical), and 4.6 weight % of Irganox TM 1010 from Ciba Geigy, a substituted phenol antioxidant (based on the weight of polymer used), [1.6 weight % of Irganox 1010 from Ciba Geigy a substituted phenol antioxidant (based on the weight of the oil/polypropylene mixture)] and mineral oil (Amoco TM White Mineral Oil #31 USP Grade available from Amoco Oil Co.) at a weight ratio of polypropylene to mineral oil of 35:65, were mixed in a Berstorff TM 40 mm twin screw extruder operated at a decreasing temperature profile of 266° C. to 166° C., the mixture was extruded, at a total throughput rate of 20.5 kg/hr., from a 30.1 cm×0.7 mm slit gap sheeting die onto a chill roll casting wheel. The wheel was maintained at 65.6° C. and the extruded material solid-liquid phase separated. A continuous sheet of this material was collected at 1.98 meter/min. and passed through a 1,1,1-dichloro - 2,2-trifluoroethane (duPont TM Vertrel 423) bath to remove 75–85% of the mineral oil. The resultant washed film was lengthwise stretched 125% at 110° C. It was then transversely stretched 125% at 121° C. and heat set at 149° C. The finished porous film, at a thicknesses of 0.024 cm, was tested in a 113° C. convection oven to determine its resistance to oxidative degradation. After 168 hours at this temperature, the material did not show any visible signs of degradation including cracking upon bending the product 180° around a 3.2 mm mandrel.

A second example of the microporous material is the following.

Polymethylpentene (DX-845), available from Mitsui Petrochemical Industries, Ltd., 0.25 weight percent (based on the polymer) dibenzylidene sorbitol nucleating agent (Millad TM 3905, available from Milliken Chemical), and 4.6 weight % of Irganox TM 1010 from Ciba Geigy, a substituted phenol antioxidant (based on the weight of polymer used), and mineral oil (Amoco TM White Mineral Oil #31 USP Grade available from Amoco Oil Co., at a weight ratio of polymethylpentene to mineral oil of 35:65, were mixed in a Berstorff TM 25 mm twin screw extruder operated at a decreasing temperature profile of 271° C. to 222° C., the mixture was extruded, at a total throughput rate of 4.5 kg/hr., from a 35.6 cm×0.6 mm slit gap sheeting die onto a chill roll casting wheel. The wheel was maintained at 71° C. and the extruded material solid-liquid phase separated. A continuous sheet of this material was collected at 0.78 meter/min. and passed through a 1,1-

Dichloro2,2-Trifluoro Ethane (duPont TM Vertrel 423) bath to remove approximately 60% of the initial mineral oil. The resultant washed film was lengthwise stretched 200% at 121° C. It was then transversely stretched 200% at 121° C. and heat set at 121° C.

The article of the above described examples has a microporous structure characterized by a multiplicity of spaced, i.e., separated from one another, randomly dispersed, nonuniform shaped, equiaxed particles of thermoplastic polymer and connected by fibrils. (Equiaxed means having approximately equal dimensions in all directions.) The term "thermoplastic polymer" is not intended to include polymers characterized by including solely perfluoro monomeric units, e.g., perfluoroethylene units, such as polytrafluoroethylene (PTFE) which under extreme conditions, may be thermoplastic and rendered melt processable. It should be understood also that, when referring to the thermoplastic polymer as being "crystallized" or "crystallizable," this means that it is at least partially crystalline.

Figure 2:
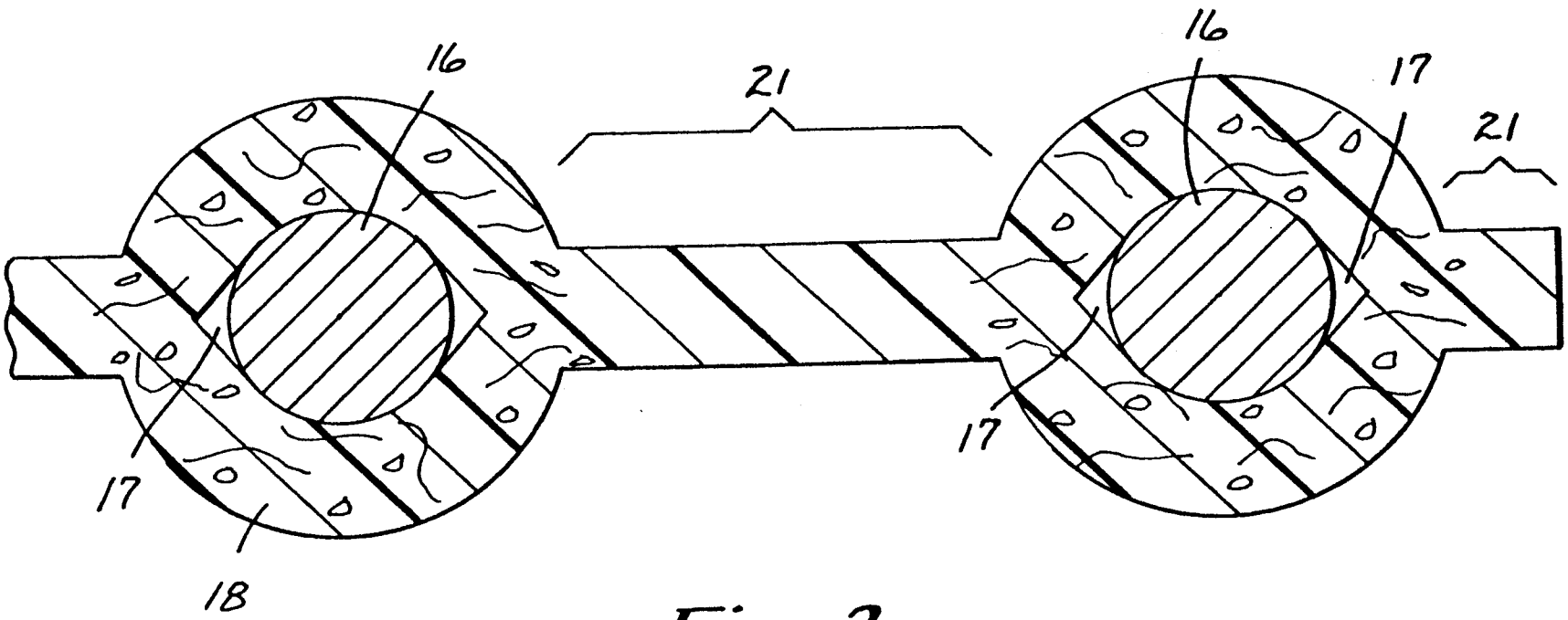
FIG. 2 is a partial cross-sectional view of the cable of FIG. 1.

FIG. 2 illustrates a cross-section of the cable of FIG. 1 taken in a position to illustrate a plurality of conductors 16 disposed in a row and surrounded by the thermoplastic polymer layer 18.

In reviewing this figure it is evident that the layers of the insulative microporous thermoplastic fibril material 18 are bonded in an area 21 between the conductors 16 and outboard of the conductors on the edge of the cable or ends of the row of conductors 16. The insulative material of the two sheets is reduced in thickness in the bonding area 21. This bonding of the sheets of dielectric material defines a spacing between the conductors and positions the fibril dielectric insulator 18 about each conductor 16 in the cable. There is a noticeable eye formed by the voids 17 remaining adjacent each side of the conductors. This eye can be reduced in dimension by appropriate laminating tool design.

The bonding in the area 21 is accomplished by heat fusing of two or more webs or sheets of the thermoplastic polymer together in the area 21 on each side of a conductor 16.

Figure 3:
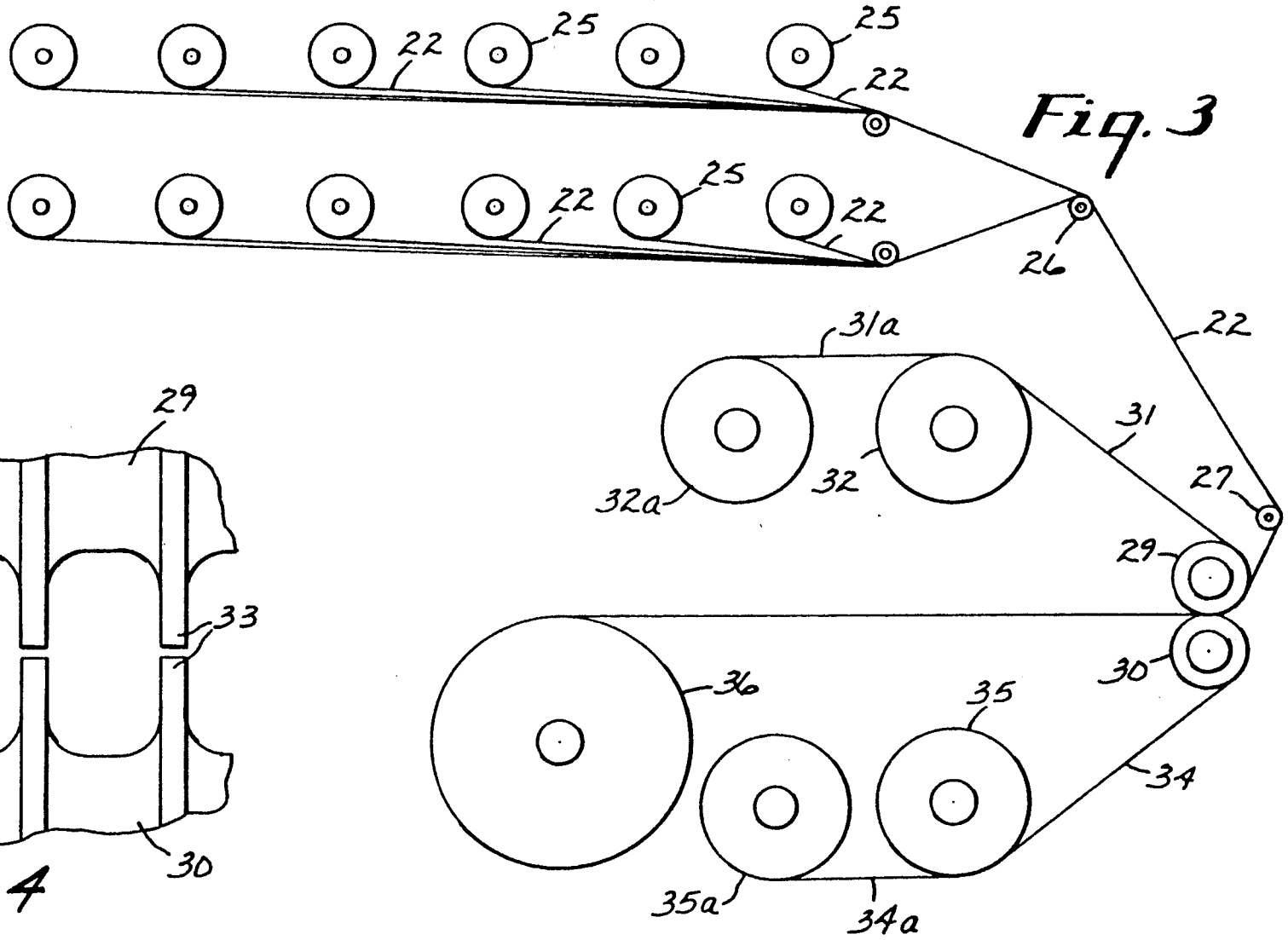
FIG. 3 is a schematic view of the manufacturing process to form the cable of FIG. 1.

Referring now to FIG. 3, the cable according to the present invention is formed by dispensing a plurality of conductive fibers or wires 22 from supply reels 25 over guide rolls 26 and 27 and between an upper tooling roller 29 and a lower tooling roller 30. Around the upper tooling roller 29 is guided a first continuous sheet 31 of microporous thermoplastic polymer drawn from a roll 32. To increase the thickness of the insulation, a second continuous sheet 31*a* of microporous thermoplastic polymer may be drawn from another supply roll 32*a*. A third continuous sheet 34 of microporous thermoplastic polymer is drawn from a roll 35 and is guided around the lower tooling roller 30. Again, a fourth continuous sheet 34*a* of material may be drawn from a supply roll 35*a* and through the rollers 29 and 30. Additional sheets may be added to the laminate as desired. The conductive fibers 22 which form the conductors 16 are thus positioned in uniform spaced relationship between one or more sheets 31, 31*a* and 34, 34*a* and the laminate is wound upon a reel 36.

Figure 4:
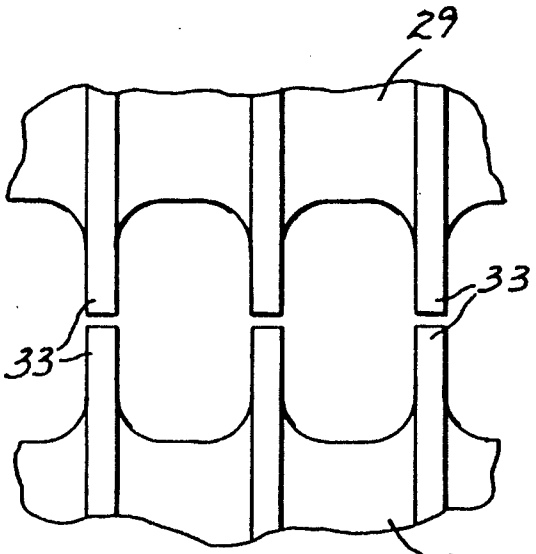
FIG. 4 is a fragmentary side view of the nip rolls of the manufacturing equipment.

The tooling rolls 29 and 30, as illustrated in FIG. 4, are formed to be adjustable to adjust the gap between the rolls and the tooling rolls 29 and 30 are formed with thin spaced disc-like portions 33 separated to allow the conductive fibers 22 and the sheets 31, 31*a* and 34, 34*a* to pass between the discs. The discs are so close, and the discs are heated to a temperature sufficient for the pressure of the rolls and the temperature thereof, they effect a bond between the webs in the area of the discs 33, as illustrated by the areas 21 which generally have a dimension corresponding to the axial dimension of the discs 33. The width of the areas 21 do not have an apparent effect on the performance of the cable.

Bonding the webs between the conductors 16 without experiencing a collapse of the web structure has been experienced by controlling the line speed through the laminator rolls 29 and 30 and controlling the temperature of the rolls 29 and 30. Typical conditions for bonding polypropylene webs are 140° C. and four (4) meters per minute.

Figure 5:
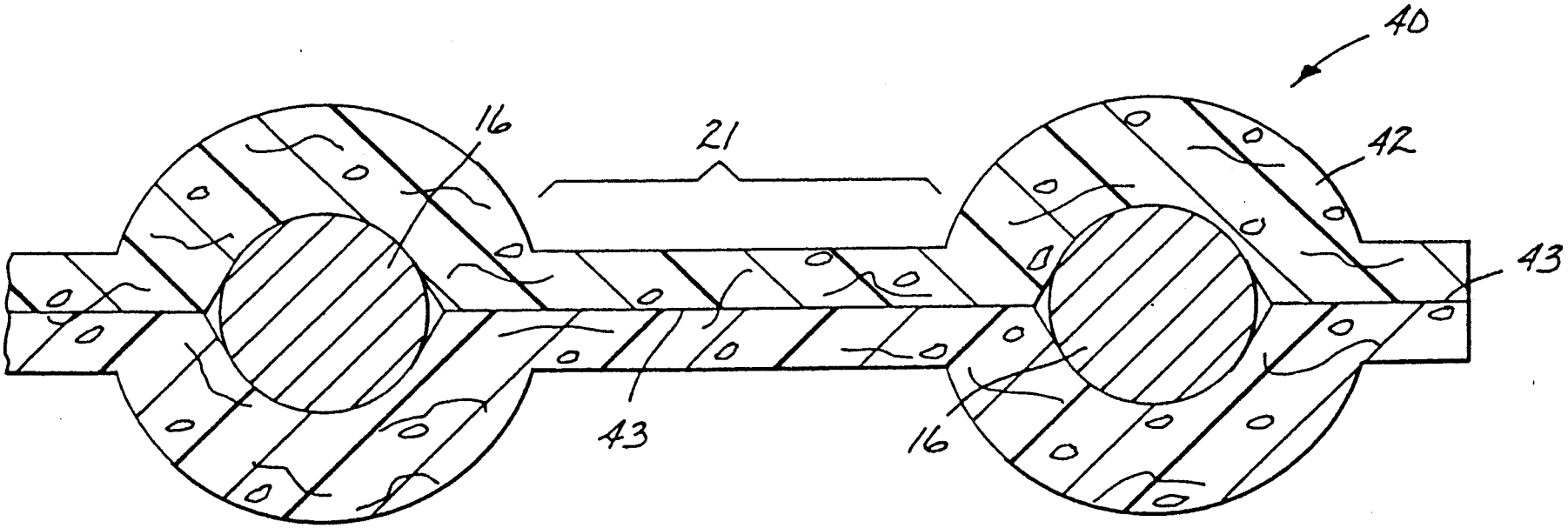
FIG. 5 is a partial cross-sectional view of a cable showing a second embodiment of the present invention.

A second embodiment of a cable 40 is illustrated in FIG. 5. In this embodiment, the webs 42, corresponding to the webs 31 and 34, are coated with an adhesive 43, preferably in strips in the bonding regions, which serves to bond the webs together between the conductors 16. The bonding process between the nip of rolls 29 and 30 can still cause a crushing of the microporous webs in the bonding areas 21 but the webs 42 are not subjected to heat as the rolls 29 and 30 are run cool when a pressure sensitive adhesive is used. If the adhesive is a heat activated adhesive, then the rolls 29 and 30 will be suitably heated to form the bond.

Referring now to FIGS. 6 and 7 a sheet material 50 is formed from a continuous metallic foil 52 in which there is formed a plurality of transverse folds 54. The transverse folds 54 are flattened in the sheet material 50 to form an area of overlap 56 which yields surprising and unexpected advantageous performance of this sheet material for use as an extensible electrical shield for an electrical cable. Optionally, the sheet material 50 may contain a liner 58 bonded to the flattened foil 52 with an adhesive 60. The adhesive 60 may either be applied before or after the flattening of the transverse folds of the metallic foil 52. In one embodiment, the adhesive 60 is applied before the sheet material 50 is flattened, see FIG. 10, which results in the inclusion of a small amount of adhesive 60 within the overlap portion 56 of the transverse folds 54. In a preferred embodiment, the transverse folds 54 occur regularly over the longitudinal length of the sheet material 50. The amount of transverse overlap 56 of each of the plurality of transverse folds 54 is not more than 35 mils. In a preferred embodiment the thickness of the continuous metallic foil 52 is between 0.0005 and 0.002 inch (0.0127 and 0.05 mm). The continuous metallic foil 52 may be constructed from a good metallic conductor such as copper or aluminum. The metallic foil 52 should be highly conductive, i.e., exhibit a sheet resistivity of not more than $20\times10^{-3}$ ohms per square. In a preferred embodiment, the transverse folds 54 occur at approximately the rate of 16 transverse folds 54 per inch (per 2.54 cm). In a preferred embodiment, the adhesive 60 is a pressure sensitive adhesive such as an acrylic adhesive, 3M Brand 927 transfer adhesive available from Minnesota Mining and Manufacturing Company of St. Paul, Minn. The adhesive 60 is carried on a silicone treated removable liner 58.

The sheet material 50, as illustrated in FIGS. 6 and 7, exhibits a nonlinear yield behavior on the application of longitudinal force. With the longitudinal force below a nominal yield value, the sheet material 50 acts as a continuous foil with a minimal amount of longitudinal extension and generally will return to near its original position upon the removal of that longitudinal force. With the application of a longitudinal force above the nominal yield amount, the sheet material 50 extends quite freely.

For the purposes of the present application, the continuous metallic foil 52 may be purely a metallic foil as a copper or an aluminum foil or a laminate of an aluminum foil with a polymeric film. One embodiment utilizes Model 1001 film manufactured by the Facile Division of Sun Chemical Corporation which consists of a laminate of a 0.33 mil (0.008 mm) aluminum foil to a 0.5 mil (0.0127 mm) polyester film. In this application, all references to a metallic foil 52 include a metallic foil laminate with another conductive or nonconductive material such as polyester. A preferred embodiment utilizes 0.001 in (0.0254 mm) copper foil and 3M TM 927 transfer adhesive.

FIG. 8 illustrates an electrical ribbon cable 62 constructed utilizing the sheet material 50. A plurality of conductors 16, which may be signal conductors, lie in a single plane and are encased in the insulting material 18. The insulating material 18 is sandwiched between sheet material 50 and bonded to the sheet material 50 with adhesive 60. The view in FIG. 8 is looking between two of the transverse folds 54 of FIGS. 6 and 7. In a preferred embodiment, the conductors 16 are constructed from solid copper and the insulating material 18 is constructed as described above from fibril microporous thermoplastic polymer material.

Figure 9:
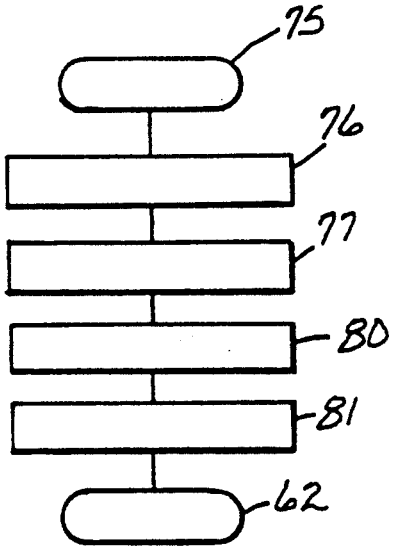
FIG. 9 is a flow diagram illustrating the method of making the sheet material of FIG. 6.
Figure 10:
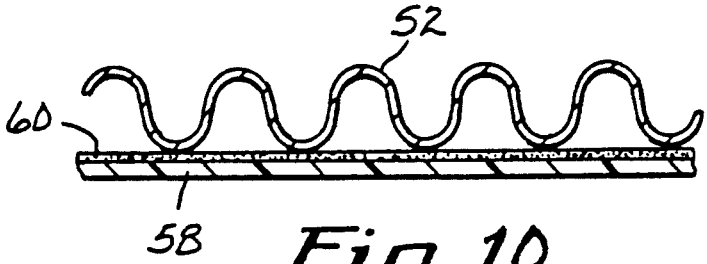
FIG. 10 illustrated an intermediate step in the fabrication of the sheet material of FIG. 6.
Figure 11:
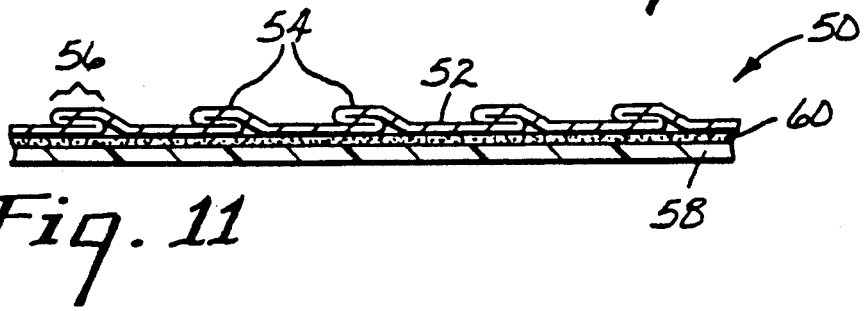
FIG. 11 illustrates the completed sheet material formed from the sheet material of FIG. 10.

FIG. 9 illustrates a flow diagram describing the method of constructing the shielding material, and optionally an electrical cable of the present invention utilizing the shielding material. The shielding material starts 75 with a sheet or strip of continuous metallic electrically conductive foil 52, which is then corrugated 76. The resulting corrugated metallic foil 52 is illustrated in FIG. 10. The preferred method of corrugating 76 the metallic foil 52 is to use two 50 mm outside diameter 16 diametral pitch meshing gears, then to run the continuous metallic foil through these meshing gears resulting in a corrugated metallic foil 52 having approximately 16 corrugations per inch (6 corrugations per cm). In this form the corrugated metallic foil 52 has an amplitude distance of approximately 0.9 mm. The carrier is then applied which means applying the transfer adhesive tape, comprising the adhesive 60 and liner 58, to the corrugated foil, applying 77, to the corrugated metallic foil 52. The lamination is then flattened 80 using a pair of nip rollers to flatten the corrugated metallic foil 52 to form a plurality of transverse folds 54 having transverse overlaps 56 as illustrated in FIG. 11. The next step is the wrapping 81 of the flattened sheet material 50, with the liner 58 removed, about the ribbon cable 15 to form the cable 62.

In performing the flattening step 80 it is preferred that an adhesive be utilized with the carrier or liner in order to sufficiently adhere the corrugated material 52 to a substrate so that when flattened the corrugations of the corrugated metallic foil 52 would not "creep" while the flattening step 80 is being accomplished.

Figure 12:
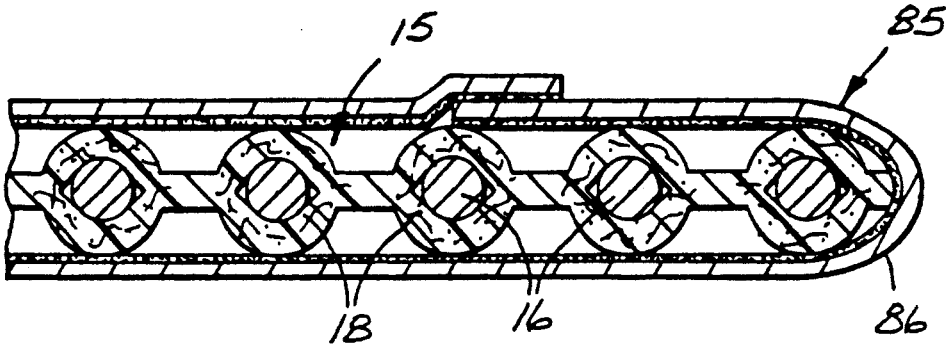
FIG. 12 is a transverse cross-sectional view of a cable according to another embodiment of the invention.

The cable 85 illustrated in FIG. 12 illustrates an embodiment of the present invention wherein a cable 15 constructed as described above is cigarette wrapped by an adhesive coated extensible metal foil or metal foil/polymer composite 86. The metal foil can be a material as described in U.S. Pat. No. 4,475,006.

Figure 13:
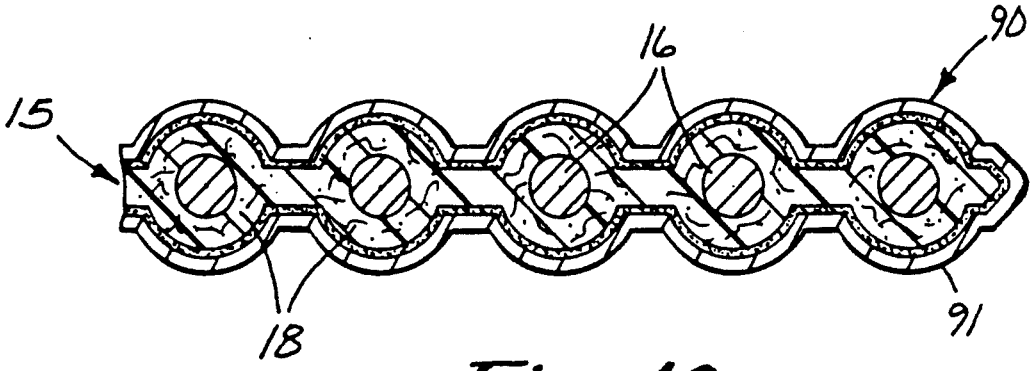
FIG. 13 is a transverse cross-sectional view of still a further embodiment of the present invention.

FIG. 13 discloses a cable 15 constructed according to FIGS. 1–4 wherein the cable structure 90 includes an adhesive coated foil 91 intimately bonded to the outer surface of the cable 15. The foil 91 is an extensible foil or foil/polymer composite which will have sufficient ductility to stretch without tearing or cracking when applied over the outer surface of the cable 15 and conform to the surface configuration. An example of a suitable metal foil is No. 1069 available from NEPTCO Incorporated, 30 Hamlet Street, Pawtucket, R.I. 02861-0323.

By example, Table 1 illustrates the improved transmission line properties of the subject shielded ribbon cable over the state of the art shielded ribbon cables. Product A in the table is published data for "RibbonAx" (trademark) cable with 30 AWG wire from W. L. Gore & Associates, Inc., product B is a cable, No. 90101, from the assignee of this application using 30 AWG solid wire with solid thermoplastic elastomer insulation and the folded shielding material, product C represents a cable according to the present invention using polypropylene and 30 AWG wire and the folded shielding material, product D represents a cable according to the present invention using polypropylene and 30 AWG solid wire and the folded shielding material, and product E represents values from tests on a cable constructed according to the present invention using polypropylene and 33 AWG wire, spaced 0.63 mm and having 0.28 mm of dielectric. Product A is on 1.27 mm spacing. Products B, C, D and E are on 0.635 mm spacing.

TABLE 1

| Product | Capacitance Pf/Meter | Impedance Ohms | Propagation Delay Nanosec/Meter | % Velocity in Air | Effective Dielectric Constant | Core Cable Thickness (mm) |
|---|---|---|---|---|---|---|
| Gore A | 88.6 | 50 | 4.69 | 71 | 1.98 | N/A |
| *3M 90101 B | 93.2 | 53 | 4.99 | 67 | 2.23 | 0.89 |
| *New C | 82.0 | 52 | 4.04 | 83 | 1.47 | 0.51 |
| *New D | 52.5 | 76 | 3.90 | 85 | 1.37 | 0.81 |
| *New E | 48.1 | 88 | 4.27 | 78 | 1.63 | 0.71 |

*All tests performed in unbalanced (single ended) configuration.

From the examples above, the electrical data indicates values for cable with microporous fibril polypropylene insulation to have shorter propagation delays resulting from the lower effective dielectric constant. The polypropylene dielectrics used for the above examples had a density of approximately 0.3 gm/cc. Ribbon cables constructed according to the present invention have lower capacitance, higher impedance, and faster propagation velocities than prior art ribbon cables of the same dielectric thickness and wire size. For example, if a cable user desired a thinner cable, cable D offers higher impedance at slightly less thickness than cable B and cable C offers similar impedance at 60% the thickness of cable B. Void volumes in excess of 70% are easily attained.

By further example, the following comparison of the thermoplastic microporous fibril insulation to existing low dielectric constant materials illustrates improved crush resistance.

To test for crush resistance, insulation samples were taken from the Gore 50 Ohm coaxial cable, available from W. L. Gore & Associates, Inc., and were cut from a larger sheet of microporous film such that physical dimensions were similar. All measurements and tests were done at room temperature. The unloaded thickness and width of each sample was measured and recorded. A sample was then placed under a bench micrometer anvil of 9.98 mm diameter. When the anvil was lowered onto the sample, a 500 gram weight was applied to the sample by the anvil of the micrometer. The sample was left in this loaded condition for ten (10) minutes and then measured. Then the weight was removed. After an interval of ten (10) minutes, the thickness was again measured. The difference between initial and loaded thickness is the amount of compression under a known load. Comparing the final thickness measurement with the initial thickness measurement provides a measurement of the insulation's ability to recover from a known load. Table 2 indicates the test results.

TABLE 2

| Cable Description | Initial Thickness w/o weight (mm) A | After 10 min. w/weight (mm) B | After 10 min. w/o weight (mm) C | % Reduction (A-B)/A | % Reduction (A-C)/A | % Recovery 100-[(A-C)/A] |
|---|---|---|---|---|---|---|
| 931-3A (12% oil) Polypropylene | 0.268 | 0.249 | 0.260 | 7.11 | 2.84 | 97.16 |
| 931-1B (17% oil) Polypropylene | 0.258 | 0.234 | 0.249 | 9.36 | 3.45 | 96.55 |
| 931-2B (26% oil) Polypropylene | 0.258 | 0.231 | 0.248 | 10.34 | 3.94 | 96.06 |
| Gore 50 ohm 5000-5 Single thickness | 0.058 | 0.050 | 0.053 | 13.91 | 9.57 | 90.43 |
| Gore 50 ohm 5000-5 Double thickness | 0.124 | 0.109 | 0.114 | 12.24 | 8.57 | 91.43 |
| 473-21A Polyethylene | 0.104 | 0.084 | 0.090 | 19.02 | 13.41 | 86.59 |
| 839-7 Polyethylene | 0.142 | 0.108 | 0.121 | 24.11 | 14.64 | 85.36 |
| 699-3 TPX Polymethylpentene | 0.160 | 0.145 | 0.152 | 9.52 | 4.76 | 95.24 |

(A-B)/A reflects the overall reduction in thickness during the crush part of test.
(A-C)/A reflects the recovery or "spring back" of the material.
% Recovery refers to the percent of the initial thickness remaining after the test.

In the above test the microporous polypropylene material and the polymethylpentene material recovered to an amount greater than 92% of the original thickness. In fact the preferred range is 95% or greater. The PTFE material from the Gore cable recovered to only between 90 and 91.43% of the original thickness. This improved crush resistance affords lower bend radii and improved handling and routing durability. The polyethylene material recovered less than 90% of its original thickness and lacked the desired crush resistance.

These results show that the polypropylene and polymethylpentene materials provide a structure which exhibits a high degree of crush resistance improvement over PTFE. The reasons are believed to be the increased stiffness of the material over polyethylene and PTFE, in that the Young's Modulus is greater for polypropylene and polymethylpentene (TPX). The above table conclusively shows the improved crush resistance between these two polyolefins and also shows improved resiliency, defined as the ability to return to original shape upon the removal of stress.

Table 3 below shows the results of an additional test for crush resistance, using similar Gore material samples and the polypropylene material with 17% oil. All measurements and tests were done at room temperature. The unloaded thickness and width of each sample was measured and recorded. A sample was then placed under a bench micrometer anvil of 9.98 mm diameter. When the anvil was lowered onto the sample, a 1500 gram weight was applied to the sample by the anvil of the micrometer which corresponds to approximately 191.55 kPa pressure. The sample was left in this loaded condition for ten (10) minutes and then measured. The weight was then removed. The thickness was again measured after a ten (10) minute interval. The difference between initial and loaded thickness is the amount of compression under a known load. Comparing the final thickness measurement with the initial measurement provides a measurement of the insulation's ability to recover from a known load. The data is recorded in Table 3.

TABLE 3

| Cable Description | Initial Thickness w/o weight (mm) A | After 10 min. w/weight (mm) B | After 10 min. w/o weight (mm) C | % Reduction (A-B)/A | % Reduction (A-C)/A | % Recovery 100-[(A-C)/A] |
|---|---|---|---|---|---|---|
| 931-1B (17% oil) Polypropylene | 0.259 | 0.220 | 0.249 | 15.20 | 3.92 | 96.08 |
| Gore 50 ohm 5000-5 Single Thickness | 0.060 | 0.042 | 0.046 | 29.79 | 22.55 | 77.45 |
| Gore 50 ohm 5000-5 Double thickness | 0.130 | 0.105 | 0.114 | 18.63 | 11.76 | 88.24 |

(A-B)/A reflects the overall reduction in thickness during the crush part of test.
(A-C)/A reflects the recovery or "spring back" of the material.
% Recovery refers to the percent of the initial thickness remaining after the test.

Table 3 demonstrates the improved crush resistance of the microporous thermoplastic fibril polypropylene insulative material according to the present invention. This improved crush resistance allows smaller bend radii and improved handling and routing durability.

These results show that the polypropylene and polymethylpentene material provide a structure which exhibits a high degree of crush resistance improvement over PTFE.

The success of this process and product lies in the careful control of the materials used in the extrusile composition. The amount of mineral oil left in the matrix of the extrudate helps retain antioxidant in the structure but at the same time increases its heat transfer. Resistance to elevated temperatures, oxidative degradation of high internal surface porous film, requires that minimum levels of specific antioxidants, (preferably a hindered phenol) be present in the finished film. The high levels of antioxidant in the extrusile composition, 10 to 20 times the levels normally used, is necessary because the solvent washing operation can remove up to 80% of the antioxidant with the oil. When the cast polypropylene/oil film is solvent washed to a specific minimum residual oil level of 15% to 25% by weight of the finished film, the added antioxidant assures that adequate antioxidant will remain in the oriented finished film. The amount of mineral oil left in the film, however increases its heat transfer. The higher heat transfer will cause some collapse of the fibril structure during lamination in areas adjacent the bond area, thus increasing the insulation dielectric constant. Too little oil will cause an excessive amount of antioxidant to be removed causing the product to fail after a relatively short interval at elevated temperatures. Therefore, the level of oil retained to achieve the proper balance, is preferably between 15% and 25% by weight of the finished film.

A ribbon cable could also be made using adhesive to bond the top and bottom insulation in the bond zones without the use of high bonding temperatures but this is not the preferred method since the adhesive would have a higher dielectric constant which would reduce the cable electrical performance.

For use in the manufacture of wires and cables as disclosed herein, the microporous thermoplastic material should preferably have a density of between 0.82 gm/cc and 0.18 gm/cc and the webs 31 and 34 forming the dielectric are between 0.10 mm and 2.5 mm thick. The conductor sizes can vary and the thickness of the webs may vary as well to meet specific electrical requirements.

Thus, a novel and improved cable construction has been shown and described. It is to be understood, however, that various changes, modifications and substitutions in the form of the details of the present invention can be made by those skilled in the art without departing from the scope of the invention as defined by the following claims.

We claim:

1. A cable for transmitting electromagnetic signals comprising:

a plurality of conductors disposed in a side-by-side parallel array to form a row of electrical conductors, said row having opposite sides and ends, a layer of thermally stable, crush resistant, fibril microporous heat sealable thermoplastic crystallizable polymer dielectric disposed on opposite sides of said row of conductors, said dielectric having a void volume in excess of 70%, a propagation velocity of the insulated conductor greater than 75% the propagation velocity in air and the recovery rate after being under a 500 gram weight for 10 minutes greater than 92% of the initial thickness, said layers of dielectric being bonded to each other on each side of each conductor, and a layer of metal applied to the surface of said thermoplastic material and surrounding the row of conductors to shield the conductors.

2. A cable according to claim 1 wherein the dielectric has a density of less than 0.3 gm/cc.

3. A cable according to claim 1 wherein said metal layer is adhered to the thermoplastic dielectric and that said metal layer is flexible in that said metal layer is formed with folds extending transverse to the length direction of said conductors.

4. A cable according to claim 1 wherein said metal layer is adhered to the thermoplastic dielectric and that said metal layer is extensible in that said metal layer is sufficiently stretchable to afford routing and handling of the cable without breaking and cracking and said metal layer is adhered to the thermoplastic material and surrounds said row of conductors.

5. A cable according to claim 1 wherein said thermoplastic dielectric is polypropylene.

6. A cable according to claim 1 wherein said thermoplastic dielectric is polymethylpentene.

7. A cable according to claim 1 wherein said metal material is a laminate of a polymeric film and metal foil.

8. A cable according to claim 3 wherein said thermoplastic dielectric is a polyolefin.

9. A cable according to claim 4 wherein said thermoplastic dielectric is a polyolefin.

10. A cable according to claim 8 wherein said polyolefin is one of polypropylene or polymethylpentene.

11. A cable according to claim 9 wherein said polyolefin is one of polypropylene or polymethylpentene.

12. A cable according to claim 7 wherein said thermoplastic dielectric is one of polypropylene or polymethylpentene.

13. A ribbon cable comprising a plurality of generally parallel spaced conductive fibers defining a row of electrical conductors, a layer of fibril microporous heat sealable thermoplastic material positioned on opposite sides of said row of conductors with said layers bonded together between said conductors to form a dielectric layer surrounding each said conductor and to form the ribbon cable, and a layer of metal wrapped about the ribbon cable, said layer of metal being adhered adhesively to and intimately contacting the outer surface of the cable to afford a shield about the cable.

14. A ribbon cable according to claim 12 wherein said layer of metal comprises a metal foil/polymeric film composite.

15. A ribbon cable according to claim 13 wherein the layer of metal is adhered to the thermoplastic material layer by an adhesive.

16. A ribbon cable according to claim 15 wherein said thermoplastic material comprises a crystallizable polymer having a void volume in excess of 70%, a propagation velocity of the insulated conductor greater than 75% the propagation velocity in air and the recovery rate after being under a 500 gram weight for 10 minutes greater than 92% of the initial thickness, and said adhesive is a pressure sensitive adhesive adhering said layer of metal to said thermoplastic material.

17. A ribbon cable according to claim 16 wherein said crystallizable polymer is polypropylene.

18. A ribbon cable according to claim 16 wherein said crystallizable polymer is polymethylpentene.

19. The process of making a shielded multi-fiber ribbon cable comprising the steps of placing a plurality of conductive fibers in parallel close spaced relationship to form a row of data transmitting conductors in transverse section, positioning a web of microporous dielectric thermoplastic polymer against each side of said row of conductors, bonding the webs together in the area between the conductors, said bonding step comprising advancing said fibers and said webs of polymer between opposed rolls for placing the webs in intimate contact in areas between the fibers and to bond the webs in said areas, and wrapping the bonded webs and conductors in a layer of metal and adhering the metal layer to the polymer.

20. The process according to claim 19 wherein said wrapping step comprises the step of forming the metal layer into a web with transverse folds comprising the steps of corrugating a metal web, applying a carrier to the corrugated web, flattening the corrugations to form a plurality of transverse folds in the web, and cigarette wrapping the web about the polymer and conductors with the folds positioned transverse to the conductors.

21. The process according to claim 19 wherein the wrapping step comprises the step of coating a metal layer with an adhesive and cigarette wrapping the layer of metal about the polymer to bond the metal layer to the polymer.

22. The process according to claim 19 wherein the metal layer is a metal foil/polymeric film laminate and the wrapping step comprises the step of conforming the metal layer intimately to the polymer disposed about the conductors to conform to the surface thereof.

23. The process according to claim 19 wherein said thermoplastic polymer has a void volume in excess of 70%, a propagation velocity of the insulated conductor greater than 75% the propagation velocity in air and the recovery rate after being under a 500 gram weight for 10 minutes greater than 92% of the initial thickness, said layers of dielectric being bonded to each other on each side of each conductor.

* * * * *